US005094287A

United States Patent [19]

Vargas et al.

[11] Patent Number: 5,094,287

[45] Date of Patent: Mar. 10, 1992

[54] VERTICAL FABRIC VANE WEIGHT SYSTEM

[75] Inventors: Jose M. Vargas, Los Angeles; Mark H. Shanker, Newport Beach, both of Calif.

[73] Assignee: M & B Mini-Blind Corp., Los Angeles, Calif.

[21] Appl. No.: 607,577

[22] Filed: Nov. 1, 1990

[51] Int. Cl.[5] ..... E06B 9/30

[52] U.S. Cl. ..... 160/178.1; 160/349.1

[58] Field of Search ..... 160/178.1, 900, 349.1; 24/458

[56] References Cited

U.S. PATENT DOCUMENTS

| | | | |
|---|---|---|---|
| 2,457,442 | 12/1948 | Brent | 160/178.1 |
| 2,717,035 | 9/1955 | Groth | 160/178.1 |
| 3,500,896 | 3/1970 | Endou | 160/168.1 |
| 3,996,988 | 12/1976 | de Wit | 160/168.1 |
| 4,102,381 | 7/1978 | Bratschi | 160/168.1 |
| 4,128,914 | 12/1978 | de Wit | 16/1 R |
| 4,407,350 | 10/1983 | Nakamura | 160/178.1 |
| 4,529,025 | 7/1985 | Oskam | 160/178.1 |
| 4,597,429 | 7/1986 | Driessen | 160/236 |
| 4,696,336 | 9/1987 | Dixon | 160/178.1 |
| 4,744,612 | 5/1988 | Winter | 24/458 |

FOREIGN PATENT DOCUMENTS

| | | | |
|---|---|---|---|
| 1392927 | 5/1975 | United Kingdom | 160/349.1 |

*Primary Examiner*—Blair M. Johnson
*Attorney, Agent, or Firm*—Harvey S. Hertz

[57] ABSTRACT

A vertical fabric vane weight system is used to interconnect a plurality of fabric vanes. The vertical vanes are secured at their top end to a head rail and the botton ends are freely movable. An enclosed pocket is formed adjacent to the bottom of each vertical vane, each vane having a weight positioned in its respective pocket. A continuous chain member interconnects the weights along one edge of the vanes. Clips are used to interconnect the continuous chain to each of the weights and are removable should the chain not be a desirable feature.

1 Claim, 1 Drawing Sheet

VERTICAL FABRIC VANE WEIGHT SYSTEM

BACKGROUND OF THE INVENTION

1. Field of the Invention

The invention relates in general to vertical fabric vane weight systems, and more particularly, to a weight system utilizing a single chain which eliminates the attendant twisting of the vanes when only a single chain is used.

2. Description of the Prior Art

Conventional vertical fabric vanes utilize a pair of chains, each chain interconnecting one edge of the vanes at the bottom thereof. The chains are attached to a weight positioned in a sling formed at the bottom of the vane. Such a system avoids the twisting of the vanes which would take effect during traverse and rotation of the vanes when only one chain is utilized. In addition, the two chains system prevents the weight from slipping out of the fabric sling. In alternate arrangements, when the weights are completely sealed in the vane, chains could not be used to interconnect the vanes and twisting and free movement of the vanes would occur resulting in tangling and twisting of the vanes. Other known prior art included U.S. Pat. Nos. 4,128,914; 4,529,025; 4,407,350; 4,696,336; 3,500,896; 2,717,035; 3,996,988; 2,457,442; 4,102,381; and 4,597,429.

In order to overcome the attendant disadvantages of prior art fabric vane systems, the present invention provides a weight system wherein each weight is enclosed in a pocket of a fabric vane. In addition, a chain is utilized to interconnect each of the vanes in such a manner that the vanes, when in a closed position eliminate, viewing of the chain. The chain is removable should it not be needed or wanted.

SUMMARY OF THE INVENTION

Apparatus for interconnecting vertically arranged fabric vanes include a plurality of vertical vanes secured at their top end to a head rail and the bottom ends thereof being freely movable. An enclosed pocket is formed adjacent the bottom of each vertical vane. Each pocket has a weight positioned therein. A chain member interconnects the weights along one edge of the vanes. A detachable interconnecting device couples a part of the chain to each of the weights in the vanes.

The advantages of this invention, both as to its construction and mode of operation, would be readily appreciated as the same becomes better understood by reference to the following detailed description, when considered in connection with the accompanying drawings, in which like reference numerals designate like parts throughout the figures.

DESCRIPTION OF THE PREFERRED EMBODIMENT

Figure 1:
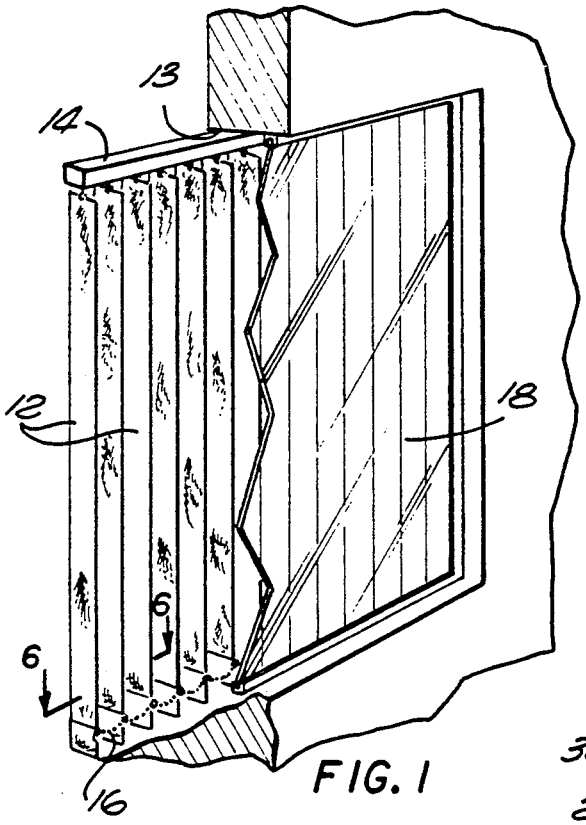
FIG. 1 is a perspective view illustrating the fabric vane system mounted on a structure.

Referring now to the drawings, there are shown in FIG. 1 a vane system including the interconnecting apparatus for the vertically arranged fabric vanes 12 constructed in accordance with principles of the invention. The vertical vanes 12 are illustrated being mounted in a window frame 13. However, it should be understood that other arrangements are possible, such as conventional ceiling to floor arrangements as well.

The vertical vanes 12 are attached at their top end to a conventional head rail 14 which is used to traverse as well as rotate the vanes. Each of the vertical vanes 12 are interconnected at the bottom end thereof by a chain 16. The chain 16 is attached to each of the vanes 12 on the edge adjacent the window 18. Thus, when the vanes 12 have been rotated to a closed position, the chain 16 is not be visible.

Figure 3:
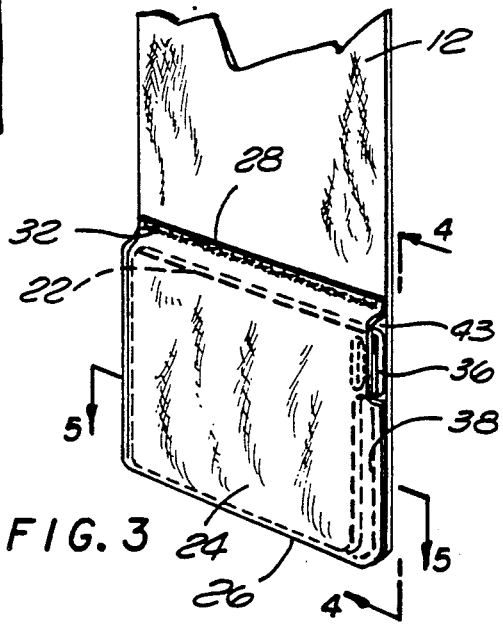
FIG. 3 is a partial perspective view of the weight of FIG. 2 shown mounted in a vane.
Figure 5:
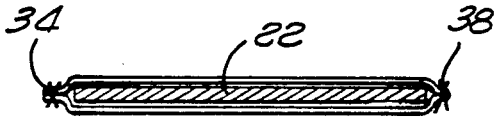
FIG. 5 is a cross-sectional view taken along the line 5—5 of FIG. 3.
Figure 4:
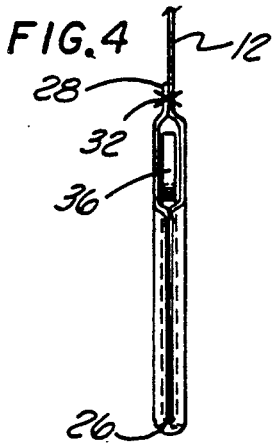
FIG. 4 is an end elevational view of the weight mounted in the vane taken along the line 4—4 of FIG. 3.

As shown in FIGS. 3 through 5, each of the vanes 12 contains a weight 22 which is enclosed in a bottom pocket 24. The bottom pocket 24 is formed by folding over the fabric vane 12 along the bottom edge 26 and then securing the terminal edge 28 of the material along a line 32 to form the top pocket seam. The front edge 34 of the bottom pocket 24 is also secured, thus, closing the pocket from view.

Figure 2:
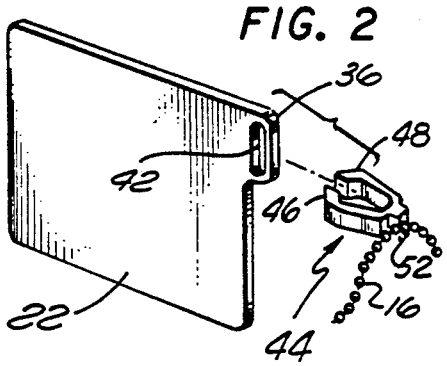
FIG. 2 is perspective view of the weight, interconnecting clip, and a portion of the chain used in the system of FIG. 1.

As illustrated in FIG. 2, the weight 22, which is of generally rectangular configuration except for an extended top ear 36, is inserted into the pocket 24 and the vane rear edge 38 material secured together except for the area adjacent the weight ear 36 and directly below the ear. Thus, access to the ear 36 and an aperture 42 formed in the ear can be obtained through the opening 43 formed above the sealed portion of the rear edge 38 of the pocket 24.

Moreover, the sealed front edge 34 and rear edge 38 abut the adjacent surfaces of the weight 22, so that the weight cannot move in the pocket 24. Thus, the ear 36 of the weight is never outside of the pocket 24 and thus cannot be seen.

Figure 6:
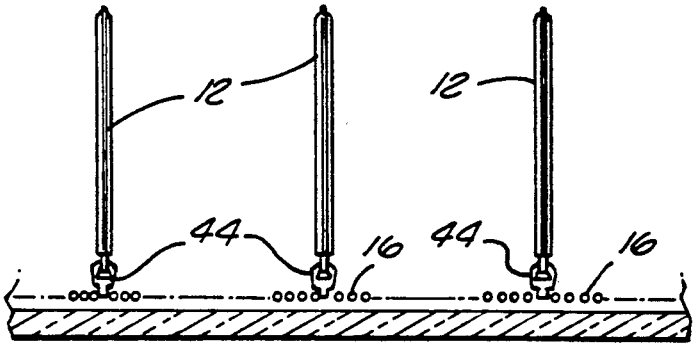
FIG. 6 is a cross-sectional view taken along the line 6—6 of FIG. 1.

A plurality of clips 44 having spring locking jaws 46, 48 are attached to each weight at the aperture 42. The chain 16 passes through an opening 52 in each of the clips 44 as shown in FIGS. 4 and 6.

The enclosed weights 22 keep the vertical vanes 12 in a normally vertical position and during traverse and rotation of the vanes 12 minimize the movement thereof as is conventional. The chain 16 enables the vanes 12 to move in unison at the bottom portion thereof without the need for a chain at the front edge of the vanes. In addition, elimination of the front chain has been found to be asthetically more pleasing and functionally as satisfactory as unenclosed weights used with the two chain system. Moreover, the removable clips 44 enable the chain to be removed from the vanes should the chain prove to be asthetically undesirable.

We claim:

1. Apparatus for interconnecting vertically arranged fabric vanes comprising:

a plurality of vertical vanes, said vanes being rectangular, each of said rectangular vanes having a bottom end, a top edge, a bottom edge, a front edge and a rear edge, the rear edge of each said vanes being positioned against a window or door when said vane is rotated in a first position; said vanes each being secured at the top edge to a head rail, the bottom edge being freely movable, an enclosed pocket formed adjacent the bottom end of each of the vertical vanes and having a weight positioned in each pocket, each said pocket being completely closed on three sides and partially enclosed on a fourth side thereof for preventing movement of said weight with respect to said vane, an opening formed on the fourth side of said pocket for enabling access of said interconnecting means to said weight;

a continuous chain member interconnecting said weights along one edge of said vanes for moving said vanes in unison; and removable means for interconnecting said continuous chain to each of said weights.

* * * * *